US012534906B2

(12) United States Patent
Keller et al.

(10) Patent No.: US 12,534,906 B2
(45) Date of Patent: Jan. 27, 2026

(54) CONNECTING ASSEMBLY FOR THE FORCE-TRANSMITTING ATTACHMENT OF A FIRST FORCE-ABSORBING STRUCTURAL PART TO A SECOND FORCE-ABSORBING STRUCTURAL PART, AND STRUCTURE

(71) Applicant: Leviat AG, Lyss (CH)

(72) Inventors: Tina Keller, Querfurt (DE); Thorsten Heidolf, Weimar (DE)

(73) Assignee: Leviat AG, Lyss (CH)

( * ) Notice: Subject to any disclaimer, the term of this patent is extended or adjusted under 35 U.S.C. 154(b) by 346 days.

(21) Appl. No.: 18/465,860

(22) Filed: Sep. 12, 2023

(65) Prior Publication Data

US 2024/0084582 A1 Mar. 14, 2024

(30) Foreign Application Priority Data

Sep. 13, 2022 (DE) ..... 20 2022 105 156.9

(51) Int. Cl.
*E04B 1/38* (2006.01)
*E04B 1/98* (2006.01)

(52) U.S. Cl.
CPC ..... *E04B 1/388* (2023.08); *E04B 1/98* (2013.01)

(58) Field of Classification Search
CPC ..... E04B 1/388; E04B 1/0038; E04B 1/98; E04B 1/78; E04B 5/36
USPC ..... 52/396.05
See application file for complete search history.

(56) References Cited

U.S. PATENT DOCUMENTS 3,422,501 A * 1/1969 Kimio ..... E04C 5/122 52/223.13
4,959,940 A * 10/1990 Witschi ..... E04B 1/0038 52/223.13
5,617,685 A * 4/1997 Meier ..... E04C 3/20 52/223.13
6,688,071 B1 * 2/2004 Evers ..... E21D 21/0026 403/307
9,951,513 B2 * 4/2018 Ladret ..... E04H 12/12
2007/0175583 A1 * 8/2007 Mosallam ..... B29C 70/088 428/411.1
2018/0023289 A1 * 1/2018 Fritschi ..... E04C 5/127 52/407.4
2018/0291620 A1 * 10/2018 Hollerbuhl ..... E04B 1/0038
2019/0017256 A1 * 1/2019 Michiels ..... E05B 65/06
2020/0002932 A1 * 1/2020 Hardy ..... E04B 1/0038
2022/0243451 A1 8/2022 Keller et al.

FOREIGN PATENT DOCUMENTS

EP 4 036 338 A1 8/2022

* cited by examiner

*Primary Examiner* — Paola Agudelo
(74) *Attorney, Agent, or Firm* — Walter Ottesen, P.A.

(57) ABSTRACT

A connecting assembly for the force-transmitting attachment of a first force-absorbing structural part to a second force-absorbing structural part includes tensile force-transmitters, shearing force-transmitters and compressive force-transmitters. The compressive force-transmitters include at least one compression element with a rod-like section. The rod-like section is provided for arrangement in a joint between the structural parts. The rod-like section is made from a metallic material. The rod-like section has a flow section with a constant cross-sectional area which is reduced compared with the rod-like section. A structure includes a connecting assembly.

24 Claims, 3 Drawing Sheets

CONNECTING ASSEMBLY FOR THE FORCE-TRANSMITTING ATTACHMENT OF A FIRST FORCE-ABSORBING STRUCTURAL PART TO A SECOND FORCE-ABSORBING STRUCTURAL PART, AND STRUCTURE

CROSS-REFERENCE TO RELATED APPLICATIONS

This application claims priority of German patent application no. 20 2022 105 156.9, filed Sep. 13, 2022, the entire content of which is incorporated herein by reference.

TECHNICAL FIELD

The disclosure relates to a connecting assembly for the force-transmitting attachment of a first force-absorbing structural part to a second force-absorbing structural part. The disclosure is also directed to a structure with such a connecting assembly.

BACKGROUND

US 2022/0243451 discloses a generic connecting assembly for the force-transmitting attachment of a first force-absorbing structural part to a second force-absorbing structural part. The first force-absorbing structural part can be, for example, a balcony slab and the second force-absorbing structural part the ceiling of a building. The connecting assembly is provided for subsequent attachment of the first force-absorbing structural part to the second force-absorbing structural part. The first force-absorbing structural part can be produced, for example, as a prefabricated part in the prefabrication plant and be transported to the construction site. Pouring and setting the first force-absorbing structural part on site is no longer required. Crane times can be minimized as a result and the structure can be erected quickly. A disadvantage of such known assemblies is that structural tolerances have to be taken into account and compensated before the connection of the second structural part. In the case of a plurality of compression elements, it must be ensured that all the compression elements contribute almost equally to the dissipation of loads. Otherwise, the element under the greatest load can fail. After that, the further compression elements can also fail one after the other because they are overloaded.

SUMMARY

It is an object of the disclosure to provide a connecting assembly of the generic type which enables compensation of tolerances at the compression element in a simple fashion. A further object of the disclosure includes providing a structure which enables compensation of tolerances at the compression element in a simple fashion.

This object is achieved with respect to the connecting assembly by a connecting assembly for a force-transmitting attachment of a first force-absorbing structural part to a second force-absorbing structural part. The connecting assembly includes: a tensile force-transmitter; a shearing force-transmitter; a compressive force-transmitter; the compressive force-transmitter including at least one compression element defining a rod-like section made of metallic material; a joint disposed between the first and second force-absorbing structural parts; the rod-like section being arranged in the joint between the first and second force-absorbing structural parts; and, the rod-like section defining a flow section having a constant cross-sectional area reduced relative to the rod-like section.

Compression elements of such assemblies are configured according to relevant standards such that the forces acting on the compression elements can be transmitted safely with the corresponding safety factor. This assumes that all the compression elements taken into account during the calculation also contribute to the load dissipation, that is, are attached to both structural parts in a force-transmitting fashion. In order to enable this force-transmitting attachment to both structural parts also in the case of positional tolerances of the structural parts and the parts of the connecting assembly relative to one another, it is provided according to the disclosure that a rod-like section of the compression element which is provided for arrangement in a joint between the structural parts has a flow section with a constant cross-sectional area which is reduced compared with the rod-like section. Because of the reduced cross-sectional area, the flow section is a section in which the elastic limit of the metallic material is exceeded earlier than in the rest of the rod-like section. If all the compression elements do not contribute equally to the load dissipation because of tolerances, an excessively high force, for which the compression element is not configured, acts on the compression elements over which the load is dissipated. As a result, the elastic limit of the material can be exceeded in the flow section and the material in the flow section is plastically deformed under the exertion of compressive force. The length of the flow section of this compression element thus reduces until a spacing which still exists from one of the structural parts is overcome and the at least one further compression element lies between the structural parts so that it can transmit compressive force. It can consequently advantageously be achieved that, after the exertion of correspondingly high forces which have caused a plastic deformation of the flow section of at least one compression element, all the compression elements lie between the structural parts so that they can transmit compressive force, and contribute to the load dissipation. Uniform load dissipation takes place in the breaking load range. Structural tolerances can be compensated within certain limits by the compression elements themselves. The arrangement of tolerance-compensating elements such as washers, levelling pastes or the like can consequently advantageously be eliminated. Because it is ensured that all the compression elements contribute to dissipating the load, overloading of individual compression elements and consequently failure of the force-transmitting connection can be avoided safely in a simple fashion.

The cross-section of the flow section and the length of the rod-like section are advantageously coordinated with each other such that the material in the flow section reaches its elastic limit under a compressive load before the rod-like section buckles. It can consequently be ensured that the compression element does not fail by buckling before the flow section reaches its elastic limit and is plastically deformed because of the compressive load. Adapting the cross-section can here be adapting the size and/or the shape of the cross-section. Alternatively, buckling of the rod-like section can also be prevented in a different manner, for example by reducing the buckling length by supporting elements.

The rod-like section does not have to bridge the whole joint. It can be provided that further elements are arranged in the joint and form a part of the compression element. In particular, fastening elements for the rod-like section, for example a nut, at which the rod-like section is retained can be arranged in the joint.

The cross-sectional area of the flow section is advantageously 55% to 80%, in particular 56% to 76% of the maximum cross-sectional area of the rod-like section. In the case of usual dimensions of the connecting assembly, such buckling of the compression element can be prevented simply before the elastic limit in the flow section is reached.

The rod-like section is preferably made from stainless steel or high-strength steel.

The width of the flow section is advantageously 15% to 25%, in particular 17% to 23% of the maximum external diameter of the rod-like section. It is intended that the width of the flow section, on the one hand, is as large as possible in order to allow the compensation of large tolerances satisfactorily and, on the other hand, the width of the flow section must not be so large that the rod-like section can buckle in the flow section.

The width of the flow section is especially 3 mm to 15 mm. The width of the flow section is especially at least 5 mm and is advantageously at least 8 mm. The width of the flow section is especially at most 14 mm and is advantageously at most 13 mm and especially at most 10 mm.

The flow section is advantageously limited on at least one side by a shoulder. The flow section is preferably limited on both sides by a shoulder. At the shoulder, the flow section merges, with a wall which runs approximately perpendicular to the longitudinal center axis of the rod-like section, into that region of the rod-like section which adjoins the flow section. The flow section is formed in particular by a straight neck. The flow section is advantageously a groove in the rod-like section. It can alternatively be provided that the flow section forms one end of the rod-like section and is configured as a straight pin. A relatively constant deformation characteristic of the compression element can be obtained by a flow section with a constant cross-section which merges via a shoulder into the adjoining sections of the rod-like section. A strictly linear curve of the force/strain diagram is not possible even in the case of a constant cross-section of the flow section because of the increase in the diameter of the flow section which results during the deformation.

The rod-like section is advantageously configured outside the flow section as a smooth rod or threaded rod, wherein the smooth rod or threaded rod has a constant external diameter. It can consequently be ensured simply with the use of a small amount of material that the material of the rod-like section first reaches the elastic limit in the flow section.

The compression element is in particular a compression rod. The rod-like section can here be routed out of the joint with the same material and diameter into one of the force-absorbing structural parts or both force-absorbing structural parts, and be embedded therein. The compression rod can be a long rod of a single material which can have a constant external diameter with the exception of the flow section. Alternatively, the rod-like section and possibly an adjoining section of the compression rod can be formed from a different material than the section provided to be embedded in a force-absorbing structural part. In particular, at least the rod-like section, that is, that region of the compression rod which is provided for arrangement in the joint, and preferably a transition section adjoining it, are formed from stainless steel. Adjoining sections of the compression rod can be formed from structural steel. The compression rod can be configured as a smooth rod or be provided with a thread or ribbing.

In an alternative embodiment, it can be provided that the compression element includes a pressure plate for embedding in a structural part. In particular, the compression element includes a pressure plate for embedding in the second structural part. However, a different arrangement with a pressure plate in the first structural part can also be provided. The compressive forces which are to be introduced can be introduced uniformly into the surrounding concrete of the corresponding structural part via the pressure plate.

The compression element advantageously includes precisely one flow section. However, in an alternative embodiment it can be provided that the compression element includes at least two flow sections. Larger tolerances can be compensated as a result.

The connecting assembly is advantageously a connecting assembly for subsequent mounting of the first structural part on the second structural part. The connecting assembly is advantageously configured such that the first force-transmitting structural part can be fixed on the second structural part after completion of the first force-transmitting structural part and the second force-transmitting structural part. At least the first structural part can here be a prefabricated part made from reinforcing steel which is produced in a prefabrication plant and is then transported to a construction site in order to be connected there to the second structural part. Alternatively, the first structural part can be a steel part. For example, the first structural part can include a plurality of steel beams which form a support structure for a balcony or the like. Because the two structural parts are completed first and then connected to each other, crane times can be minimized and the structure can be erected quickly.

In an alternative embodiment, the connecting assembly can also be advantageous for a first structural part, where the first structural part is erected on the construction site, for example using in-situ concrete, and where those parts of the connecting assembly which are provided for embedding in the first structural part are already attached to the second structural part when the first structural part is erected. The proposed tolerance compensation of the compression elements can also be advantageous in the case of such structural parts erected on site.

For a structure, it is provided that the structure includes a connecting assembly for the force-transmitting attachment of a first force-absorbing structural part to a second force-absorbing structural part.

The width of the flow section is advantageously 3% to 15%, in particular 5% to 10% of the width of the joint.

The width of the flow section is advantageously 3 mm to 15 mm, in particular 3 mm to 10 mm. Large structural tolerances can consequently be compensated satisfactorily and buckling of the compression element in the flow section can advantageously be avoided. The width of the flow section is especially 3 mm to 15 mm. The width of the flow section is especially at least 5 mm and advantageously at least 8 mm. Especially, the width of the flow section is at most 14 mm and is advantageously at most 13 mm and especially at most 10 mm.

It can be provided that insulating material, in particular an insulating body, is arranged in the joint. It can, however, also be provided that no insulating material is arranged in the joint.

The spacing of the flow section from the first structural part is advantageously less than 50% of the width of the joint, in particular less than 40% of the width of the joint. The flow section is preferably not arranged centrally in the joint and instead is arranged closer to the first structural part. The first structural part is here advantageously a structural part fastened to the second structural part, for example a cantilevered structural part such as a balcony or the like. The spacing of the flow section from that end of the rod-like section which is arranged close to the first structural part is advantageously less than 20% of the width of the joint. Arrangement close to the second structural part can, however, also be advantageous.

Compression elements with a flow section are particularly advantageous when the first force-absorbing structural part is connected via at least three compression elements with a flow section to the second force-absorbing structural part. In the case of at least three compression elements, tolerances between the compression elements can advantageously be compensated via the flow section such that the same load is dissipated over each compression element such that a uniform load dissipation results and overloading of individual compression elements is avoided.

The spacing between adjacent compression elements is advantageously at least 8 cm. The first structural part is advantageously a steel part or a reinforced concrete part. The first structural part is particularly preferably a cantilevered structural part, for example a balcony slab.

An assembly which includes respectively tensile force-transmitting means, shearing force-transmitting means and compressive force-transmitting means particularly preferably forms a module. Such a module can be, for example, a thermally insulating structural element in which the tensile force-transmitting means, shearing force-transmitting means and compressive force-transmitting means are connected to one another via an insulating body. It can also be provided that the tensile force-transmitting means, shearing force-transmitting means and compressive force-transmitting means are connected to one another in a different manner. It can also be provided that those parts of a connecting assembly which form a module are not connected to one another or only partially. The module advantageously includes at least two, in particular at least three compression elements. Each module advantageously has a width, measured in the longitudinal direction of the joint, of at least 30 cm, in particular at least 50 cm. A width of at least 30 cm is in particular provided when the module includes three or more compression elements and/or at least two tensile force-transmitting elements, in particular tension rods. A width of at least 50 cm is in particular advantageous when the module includes three or more tensile force-transmitting elements, in particular tension rods, in both structural parts.

The first structural part is advantageously connected to the second structural part via at least two, in particular at least three modules. The compression elements of a module are advantageously arranged relative to one another with a smaller spacing in the longitudinal direction of the joint than the compression elements of adjacent modules.

BRIEF DESCRIPTION OF DRAWINGS

The invention will now be described with reference to the drawings wherein.

DETAILED DESCRIPTION

Figure 1:
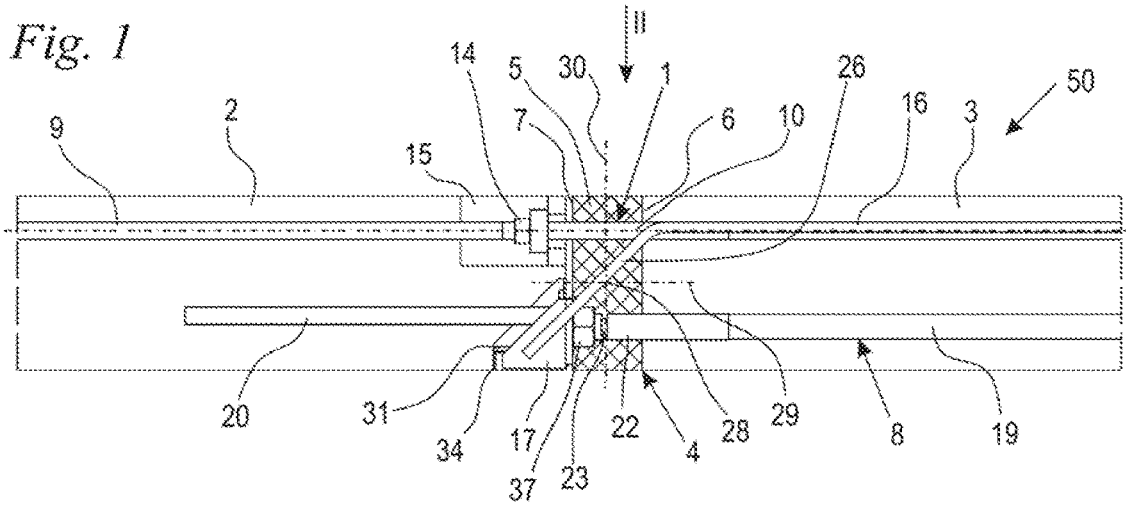
FIG. 1 shows a schematic side view of a portion of a structure.

FIG. 1 shows a schematic illustration in section of a portion of a structure 50 in the region of a connecting assembly 1. The connecting assembly 1 attaches a first force-absorbing structural part 2 to a second force-absorbing structural part 3. The first force-absorbing structural part 2 can be, for example, a cantilevered building part such as a balcony slab or the like. The second force-absorbing structural part 3 can be, for example, a roof of a building.

The connecting assembly 1 includes tensile force-transmitting means, shearing force-transmitting means and compressive force-transmitting means. In the embodiment, the tensile force-transmitting means are tension rods, wherein first tension rods 9 are embedded in the first force-absorbing structural part 2 and second tension rods 10 in the second force-absorbing structural part 3. The first tension rods 9 and the second tension rods 10 are connected to one another via a connection which is produced subsequently and is described in more detail below. An integral configuration of the tension rods 9 with the tension rods 10 can also be provided when the connecting assembly 1 is not provided for subsequent attachment.

The shearing force-transmitting means include a shear rod 16 and a bearing bracket 17 on the second structural part 3, and a support bracket 31 which is retained with a compression rod 20 in the first structural part 2.

The compressive force-transmitting means include the compression rod 20, the support bracket 31, the bearing bracket 17 and a compression element 8 which is formed by a compression rod 19 which is embedded in the second force-absorbing structural part 3. The compression rod 20, support bracket 31 and bearing bracket 17 accordingly interact both for the shearing force transmission and for the compressive force transmission. In the embodiment, a shuttering unit 34 is provided against which the support bracket 31 bears and which forms a recess for the bearing bracket 17 during the production of the first force-absorbing structural part 2. The support bracket 31, optionally together with the shuttering unit 34, is laid on top of the bearing bracket 17 when the first force-absorbing structural part 2 is attached to the second force-absorbing structural part 3, such that forces can be transmitted in a horizontal and vertical direction via the support bracket 31 and the bearing bracket 17.

The tensile force-transmitting means, the shearing force-transmitting means and/or the compressive force-transmitting means of the embodiment are shown and described by way of example and can also be formed by other elements. Such means for transmitting tensile forces, shearing forces and/or compressive forces are known to a person skilled in the art in different forms. A load application bracket or a thrust bearing can, for example, be provided instead of the compression rod 20.

In the embodiment, the connecting assembly 1 is configured as a thermally insulating structural element. The connecting assembly 1 includes an insulating body 5 which is arranged in a joint 4 between the structural parts 2 and 3. In an alternative embodiment, it can be provided that no insulating body 5 is arranged in the joint 4. In the embodiment, the tensile force-transmitting means, shearing force-transmitting means and compressive force-transmitting means of the second structural part 3 are advantageously connected to one another via the insulating body 5 before embedding in the second force-absorbing structural part 3. One or more shear rods 16 advantageously form a structural unit with a bearing bracket 17 and one or more compression rods 19 before embedding in the second force-absorbing structural part 3. The tension rods 10 can be connected to this structural unit or be formed separately from this structural unit.

The insulating body 5 has a first longitudinal side 6 which is arranged adjacent to the second structural part 3. In the embodiment, the insulating body 5 bears against the second structural part 3 with its longitudinal side 6. The opposite longitudinal side 7 lies adjacent to the first structural part 2. In the embodiment, a gap is formed between the longitudinal side 7 of the insulating body 5 and the first force-absorbing structural part 2.

The joint 4 has a longitudinal direction 28 which is oriented in the longitudinal direction of the insulating body 5. The joint 4 moreover has a transverse direction 29 which runs from the first force-absorbing structural part 2, through the joint 4 and to the second force-absorbing structural part 3. A vertical direction 30 of the joint 4 runs in the joint 4 between the structural parts 2 and 3 and is advantageously oriented perpendicularly in the installed state. The longitudinal direction 28, the transverse direction 29 and the vertical direction 30 run perpendicularly to one another.

As shown in FIG. 1, the compression rod 19 includes a rod-like section 22 which runs in the joint 4. The rod-like section 22 is fixed at a nut 37 of the bearing bracket 17. In the embodiment, the nut 37 is also arranged in the joint 4. As also shown in FIG. 1, the rod-like section 22 has a flow section 23 in which the cross-section of the rod-like section 22 is reduced compared with the maximum cross-section of the rod-like section. In the embodiment, the flow section 23 is configured as a groove with approximately straight side walls.

As shown in FIG. 1, the shear rod 16 has an angled section 26 which bridges a spacing in the vertical direction 30 between that section of the shear rod 16 which is embedded in the second structural part 3 and the bearing bracket 17.

Figure 2:
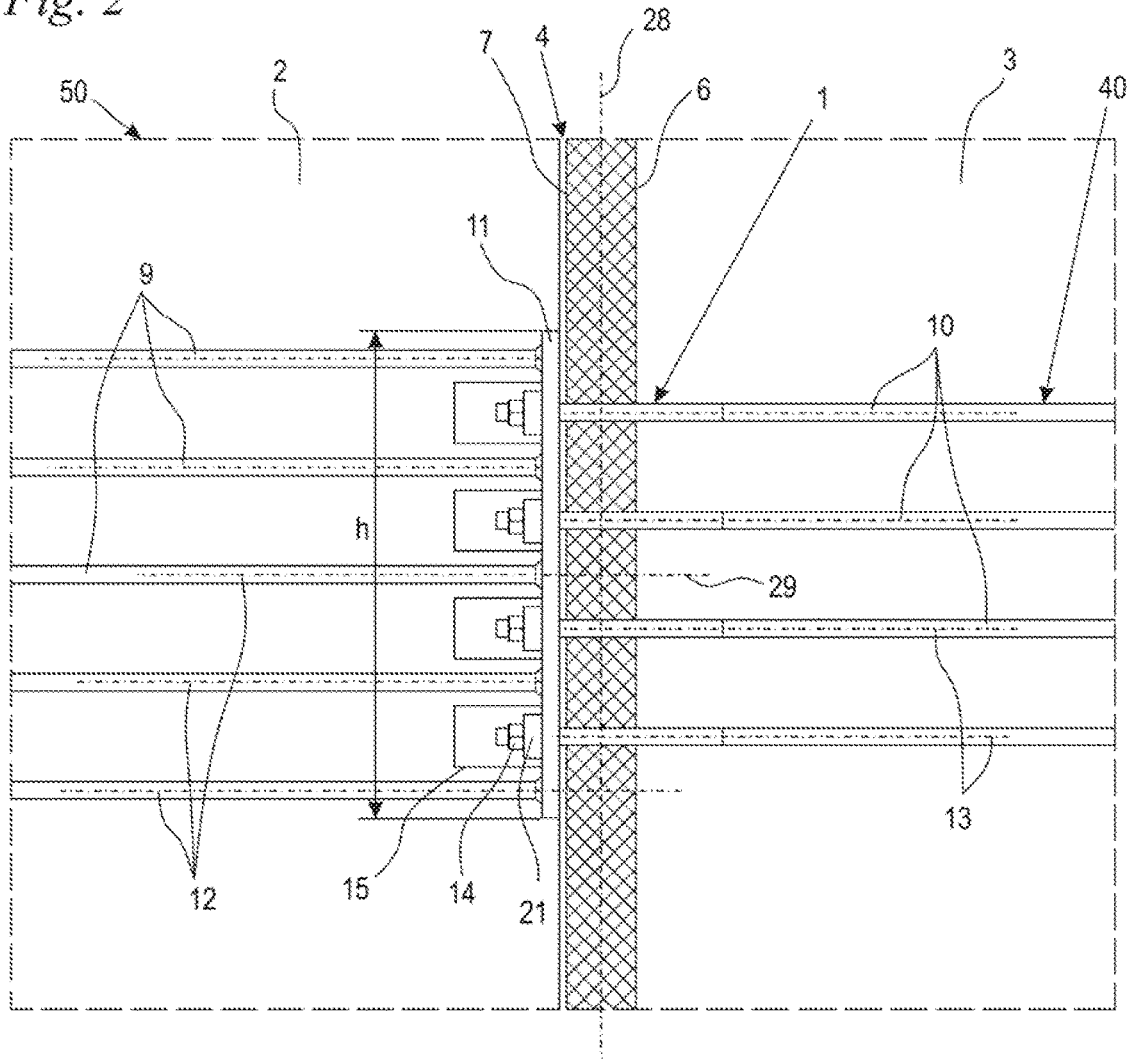
FIG. 2 shows a schematic view of the detail from FIG. 1 in the direction of the arrow II in FIG. 1.

As shown in FIG. 1 and FIG. 2, the first force-absorbing structural part has recesses 15 adjacent to the joint 4 in the region of the first tension rods 9. As shown in FIG. 2, the first tension rods 9 are fixed to a connecting plate 11 of the first force-absorbing structural part 2. The second tension rods 10 of the second force-absorbing structural part 3 are pushed through the connecting plate 11 during the mounting of the first force-absorbing structural part 2 on the second force-absorbing structural part 3 and fixed to the connecting plate via fastening nuts 14 arranged in the recesses 15. In the embodiment, a washer 21 is arranged in each case between the fastening nuts 14 and the connecting plate 11. Because the tension rods 9 and 10 are connected to one another via a threaded connection, the tension rods 9 and 10 can be connected to one another simply after production of the structural parts 2 and 3. As shown in FIG. 2, in the embodiment the tension rods 9 and 10 are arranged offset to one another in the longitudinal direction 28 of the joint 4.

In the embodiment, five first tension rods 9 and four second tension rods 10, together with in each case two associated compression rods 19 and 20, two shear rods 16 and a bearing bracket 17, form a module 40. A different number of force-transmitting elements can also be advantageous. A plurality of modules 40 are advantageously arranged over the length of the joint 4 for attachment of the first force-absorbing structural part 2 to the second force-absorbing structural part 3. In the embodiment, the width of the connecting plate 11 determines the width h of the module 40 which is measured in the longitudinal direction 28 of the joint 4.

Figure 3:
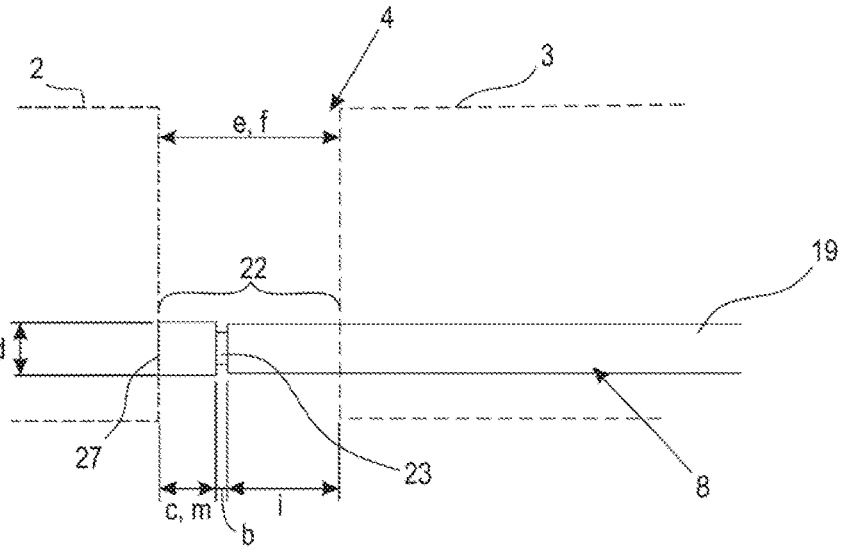
FIG. 3 shows a schematic side view of an embodiment of a compression element between two force-absorbing structural parts.

FIG. 3 shows the form of a second compression rod 19 in detail. The further elements of the connecting assembly 1 are not illustrated in FIG. 3. The compression rod 19 includes a rod-like section 22 which projects through the joint 4. In the case of the embodiment according to FIG. 3, the rod-like section 22 extends from the first force-absorbing structural part 2 as far as the second force-absorbing structural part 3. The length e of the rod-like section 22 corresponds to the width f of the joint 4. The rod-like section 22 has a maximum diameter d. In an alternative embodiment, the rod-like section 22 is configured as a threaded rod and the maximum external diameter d corresponds to the external diameter of the thread. Alternatively, the rod-like section 22 can be configured as a smooth rod or as reinforcing steel, that is, with ribs on the outside for anchoring in the concrete, or as any combination of these forms. The rod-like section is preferably a round rod. That section of the compression rod 19 which is embedded in the second force-absorbing structural part 3 is configured in the embodiment as integral with the rod-like section 22 as a threaded rod. The compression rod 19 is, including the rod-like section 22, configured with an external diameter d which is constant apart from the flow section 23 and from the same material over its whole length. The compression rod 19 can be made, for example, from structural steel, stainless steel or high-strength steel. At least the rod-like section 22 of the compression rod 19, advantageously the whole compression rod 19, is made from metal.

Figure 8:
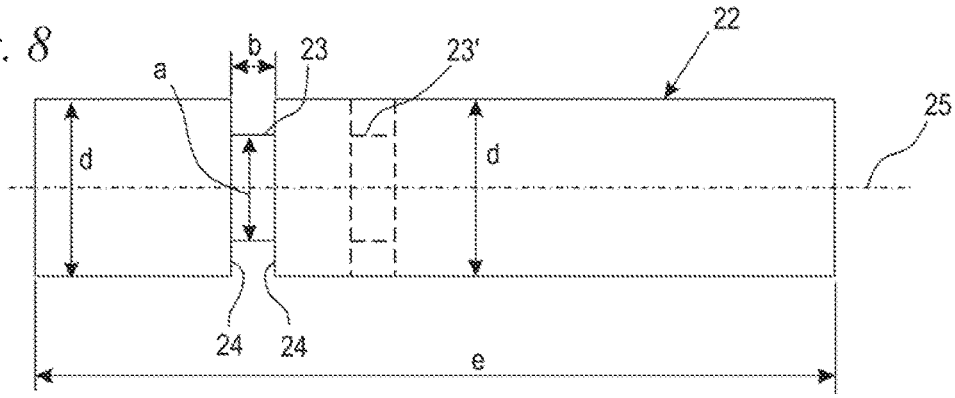
FIG. 8 shows a side view of a section of the compression element.

The flow section 23 has a cross-section which is reduced compared with the adjoining regions of the rod-like section 22. As shown in FIG. 8, the rod-like section 22 has a diameter a in the flow section 23. The diameters a and d are configured such that the cross-sectional area of the flow section 23 is 55% to 80%, in particular 56% to 76% of the maximum cross-sectional area of the rod-like section 22.

In the embodiment, the rod-like section 22 and the flow section 23 have circular cross-sections. Alternatively, other cross-sectional shapes can also be provided. In the case of a non-circular cross-section, the term "diameter" refers in the present case to the maximum width of the cross-section.

The width b of the flow section 23 is advantageously 15% to 25%, in particular 17% to 23% of the maximum external diameter d of the rod-like section 22. The width of the flow section 23 is preferably 3% to 15%, in particular 5% to 10% of the width f of the joint 4. The width b of the flow section is advantageously 3 mm to 15 mm, in particular 3 mm to 10 mm. The width of the flow section 23 is especially at least 5 mm, advantageously at least 8 mm. Especially, the width b of the flow section 23 is at most 14 mm, advantageously at most 13 mm and especially at most 10 mm. A spacing c of the flow section 23 from the first structural part 2 is advantageously less than a spacing i of the flow section 23 from the second structural part 3. The spacing c of the flow section 23 from the first structural part 2 is advantageously less than 50% of the width f of the joint 4, in particular less than 40% of the width f of the joint 4. The spacing m of the flow section 23 from that end of the rod-like section 22 which lies close to the first force-absorbing structural part 2 is advantageously less than 20% of the width f of the joint 4. In the embodiment, the spacing c corresponds to the spacing m. In the embodiment, the rod-like section 22 projects as far as the first force-absorbing structural part 2. In an alternative embodiment, further elements, for example the nuts 37 illustrated in FIG. 1, can be arranged between the rod-like section 22 and the first force-absorbing structural part 2. The spacing c can then be larger than the spacing m.

Figure 4:
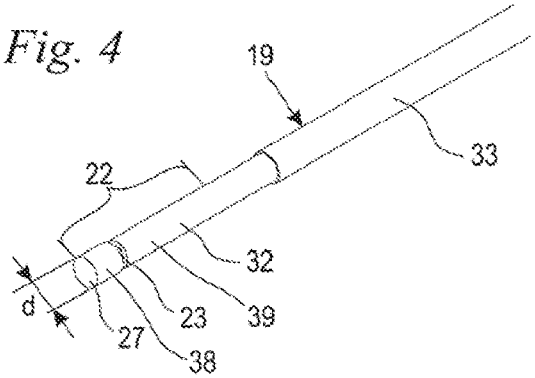
FIG. 4 shows a perspective illustration of the compression element from FIG. 3.

FIG. 4 shows by way of example an alternative embodiment of a compression rod 19. The compression rod 19 includes a smooth rod section 32 and a threaded rod section 33. The smooth rod section 32 forms the rod-like section 22 which is provided for arrangement in the joint 4. The smooth rod section 32 has a first section 38 at which the free end 27 of the compression rod 19 is formed and which is provided to bear against the first force-absorbing structural part 2. The first section 38 has the maximum external diameter d of the rod-like section 22. The flow section 23 adjoins the first section 38. A second section 39, the external diameter of which is slightly reduced compared with the maximum external diameter d, adjoins the opposite side of the flow section 23. The smooth rod section 32 projects beyond the rod-like section 22 at the side situated remote from the free end 27. A threaded rod section 33 adjoins the smooth rod section 32. Alternatively, a section with ribbing can be provided. The smooth rod section 32 is advantageously made from stainless steel or high-strength steel. The threaded rod section 33 is advantageously made from structural steel. The external diameter of the threaded rod section 33 is slightly larger in the embodiment than the maximum external diameter d of the rod-like section 22. The external diameter d of the threaded rod section 33 can alternatively be the same size as the maximum external diameter d in the first section 38.

In an alternative embodiment, it can be provided that the first section 38 and the second section 39 have the same diameter d. Such a configuration is illustrated in FIG. 8 for a rod-like section 22.

Figure 5:
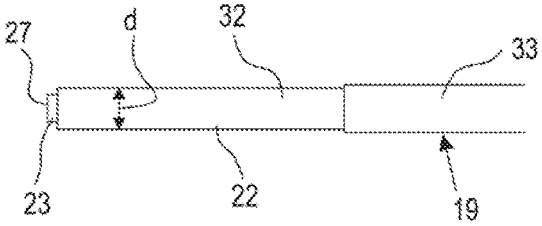
FIG. 5 shows a side view of an embodiment of a compression element.

A further embodiment of a compression rod 19 is shown in FIG. 5. The compression rod 19 from FIG. 5 includes a smooth rod section 32 and a threaded rod section 33. The smooth rod section 32 and the threaded rod section 33 can be formed from different materials and with different diameters. Alternatively, the compression rod 19 can be configured with a constant external diameter d and/or from the same material. The flow section adjoins the free end 27 of the compression rod 19. The flow section 23 is configured as a pin with a constant external diameter.

The described configurations of the compression rods 19 are given purely by way of example. Further advantageous embodiments of compression rods 19 result from any desired combination of rod-like sections which are configured as a smooth rod, threaded rod and/or reinforcing steel, that is, rod-like steel with ribbing.

Figure 6:
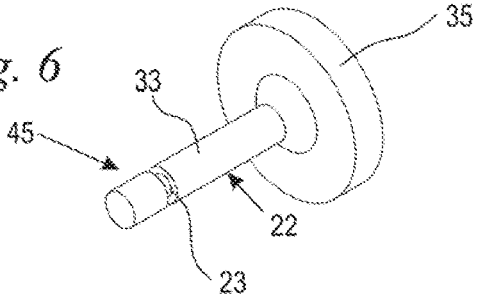
FIG. 6 shows a perspective illustration of a further embodiment of a compression element.
Figure 7:
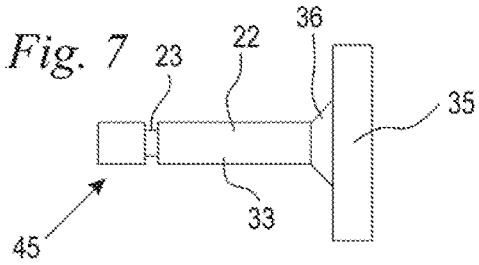
FIG. 7 shows a side view of the compression element from FIG. 6.

An alternative embodiment of a compression element 45, which is provided to be embedded in the second force-absorbing structural part 3, is illustrated in FIGS. 6 and 7. The compression element 45 includes a threaded rod section 33 to which a pressure plate 35 is fastened. The threaded rod section 33 forms the rod-like section 22. The rod-like section 22 includes a flow section 23 which is configured as a groove in the threaded rod section 33. The dimensions and the arrangement of the flow section 23 advantageously correspond to those of the above embodiments.

As shown in FIG. 7, the threaded rod section 33 can be fixed to the pressure plate, for example via a weld seam 36. The rod-like section 22 is preferably made from stainless steel or high-strength steel. Instead of being formed by a threaded rod section 33, the rod-like section 22 can also be formed by a smooth rod or be configured as reinforcing steel with ribbing. The rod-like section 22 can be configured in any suitable configuration, in particular as described in the above embodiments by any desired combinations of rod-like sections which are configured as a smooth rod, threaded rod and/or reinforcing steel, that is, rod-like steel with ribbing.

FIG. 8 shows a rod-like section 22 by way of example. The rod-like section 22 can be configured as described in the above embodiments suitably as a smooth rod, threaded rod, structural steel rod or any desired combination of these embodiments. As shown in FIG. 8, the flow section 23 has an external diameter a. The external diameter a is dimensioned in all the embodiments such that the cross-sectional area of the flow section 23 is 55% to 80%, in particular 56% to 76% of the maximum cross-sectional area of the rod-like section 22. The flow section 23 merges in each case with a shoulder 24 into the adjoining region of the rod-like section 22. The walls of the shoulder 24 advantageously run perpendicular to a longitudinal axis 25 of the rod-like section 22. The shoulders 24 are advantageously provided in a corresponding fashion for all embodiments. Both regions, adjoining the flow section 23, of the rod-like section 22 have the same maximum external diameter d.

As illustrated in FIG. 8 with a dashed line, a further flow section 23' can be provided. A third and further flow sections 23' can also be provided. Just the rod-like section 22, that is, the region of a compression element 19 or 45 which is provided for arrangement in the joint 4, is illustrated in FIG. 8. A pressure plate 35 or a compression rod 19 can adjoin the illustrated rod-like section 22, as described for the above embodiments.

Figure 9:
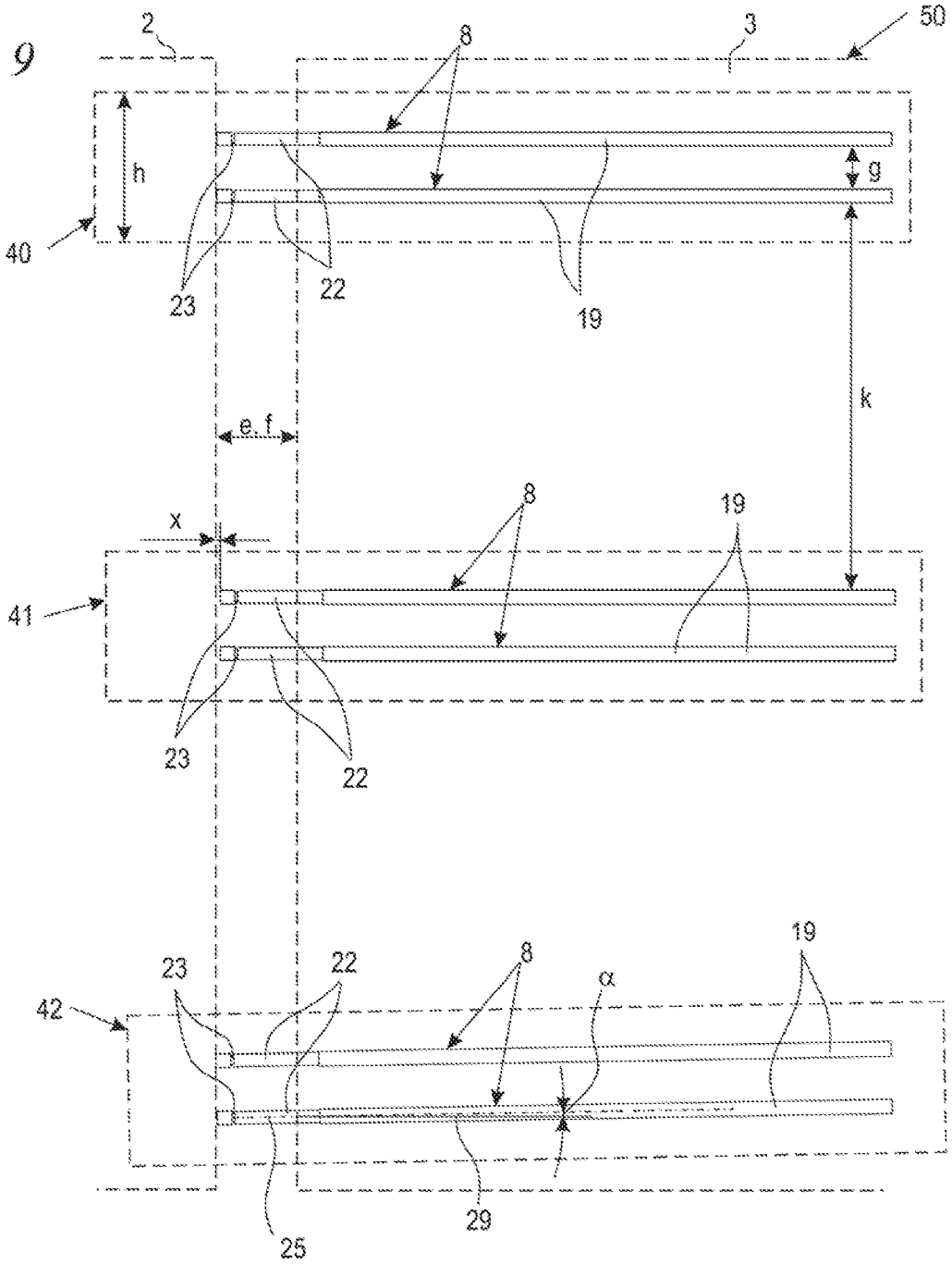
FIG. 9 shows a schematic illustration of the arrangement of a plurality of modules of the connecting assembly for the force-transmitting attachment of a first structural part to a second structural part in a structure; and, FIG. 10 shows a schematic diagram which shows the curve of the force plotted against travel for a compression element with a flow section and a compression element with no flow section.

FIG. 9 shows by way of example the arrangement of a plurality of modules 40, 41, 42 in a structure 50. At least two, in particular at least three modules 40, 41, 42 are provided for attachment of the first force-absorbing structural part 2 to the second force-absorbing structural part 3. Each module 40, 41, 42 advantageously has at least two, in particular at least three tensile force-transmitting elements. Each tensile force-transmitting element can here be formed, for example, by a first tension rod 9 and a second tension rod 10. Only the compression rods 19 are in each case illustrated as compression elements in FIG. 9. The further force-transmitting elements are not shown. Each module 40, 41, 42 has a width h. The width h is advantageously at least 30 cm, in particular at least 50 cm. Adjacent compression rods 19 of a module 40, 41, 42 have a spacing g relative to one another. The spacing g is advantageously at least 8 cm. Adjacent compression rods 19 of different modules 40, 41, 42 have a spacing k relative to one another in the embodiment which is a multiple of the spacing g. In the embodiment, the module 40 illustrated at the top in FIG. 9 is arranged such that the rod-like sections 22 bear against the first force-absorbing structural part 2 in a force-transmitting fashion. The rod-like sections 22 in the second central module 41 have a spacing x, drawn at an enlarged scale in the illustration, relative to the second force-absorbing structural part 2. The third module 42 is angled slightly to the transverse direction 29. The longitudinal axis 25 in the rod-like section 22 encloses an angle $\alpha$ with the transverse direction 29. As a result, only that compression rod 19 of the third module 42 which is illustrated at the top in FIG. 9 bears against the first force-absorbing structural part 2.

By virtue of the tolerances, in the installed situation illustrated by way of example in FIG. 9, only three of the six compression rods 19 contribute to dissipating the load. The further compression rods 19 have no contact with the first force-absorbing structural part 2. The cross-sections of the compression rods 19 in the flow sections 23 are configured such that, because of the too large a load acting on the three compression rods 19 actually contributing to dissipating the load, the yield point in these flow sections 23 is exceeded and the material is plastically deformed. The length of the rod-like sections 22 of these compression rods 19 is reduced as a result. The permissible tolerances and the width b of the rod-like sections 23 (FIG. 8) are advantageously coordinated with each other such that the flow sections 23 can deform to such an extent that all the compression elements 8 bear against the first force-absorbing structural part 2 and contribute to dissipating the load. The length e of the rod-like sections 22 is advantageously coordinated with the diameter d of the rod-like sections 22 and the diameter a in the flow section 23 such that the yield point in the flow section 23 is reached before the rod-like sections 22 buckle. As a result, it can be ensured simply that all the compression elements 8 contribute to dissipating the load.

Figure 10:
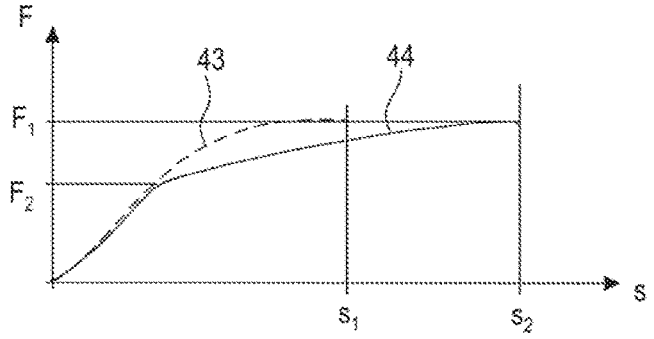

FIG. 10 schematically shows the force/travel diagram of a rod-like section 22 with an increasing compressive load. A dashed line 43 represents the force/travel curve in the case of a rod-like section 22 with a constant external diameter, that is, with no flow section 23. In the case of such a rod-like section 22, the force F first rises approximately proportionally to the travel s. The rod-like section 22 then begins to buckle and fails after reaching a travel s1 with a force F1.

The solid line 44 represents the force/travel curve in the case of a rod-like section 22 with a flow section 23 according to the disclosure. At first, the force F rises in accordance with the line 43 approximately proportionally to the travel s. When a force F2 is reached, the material in the flow section 23 reaches its elastic limit and begins to be plastically deformed, that is, to flow. The deformation travel consequently increases relatively sharply as the force continues to rise. The rise in the force F slows down. The slope of the line 44 is less than the slope of the line 43 after exceeding the force F2. After reaching the force F1 and after a deformation travel s2, the rod-like section 22 buckles and breaks. The deformation travel s2 is here greater than the deformation travel s1. The force beyond which the rod-like section 22 with the flow section 23 buckles can also be slightly less than the force F1 at which a rod-like section 22 with no flow section 23 buckles. The flatter rise in the load when the force F1 is exceeded enables differences in tolerances to be compensated.

In the embodiment, a possible configuration of a connecting assembly 1 is illustrated in FIGS. 1 and 2. The rod-like section 22 according to the disclosure with a flow section 23 can, however, be advantageous irrespective of the configuration of the connecting assembly 1 and irrespective of whether the connecting assembly 1 is provided for subsequent connection of a first force-absorbing structural part 2 to a second force-absorbing structural part 3 or whether the first force-absorbing structural part 2 is produced, for example cast from concrete, on the second force-absorbing structural part 3. Other configurations of compression elements 8, 45 can also be advantageous.

The rod-like sections 22 can in all embodiments have a constant external diameter, or sections with different external diameters, outside the flow section 23 and be configured as a smooth rod, threaded rod, reinforcing steel rod or any desired combination of these embodiments. The anchoring of the compression elements 8, 45 in the second force-absorbing structural part 3 can be chosen suitably and is not limited to the embodiments illustrated and combinations with rod-like sections 22. The anchoring of the compression elements 8, 45 in the second force-absorbing structural part 3 can be configured, for example, as a compression rod 19, pressure plate 35 or in another fashion for introducing compressive forces and be combined as desired with the described configurations of rod-like sections 22.

In all the embodiments, the compression elements 8, 45 are provided for embedding in the second force-absorbing structural part 3. Alternatively, in all the embodiments, embedding in the first force-absorbing structural part 2 can also be provided.

It is understood that the foregoing description is that of the preferred embodiments of the invention and that various changes and modifications may be made thereto without departing from the spirit and scope of the invention as defined in the appended claims.

The invention claimed is:

1. A connecting assembly for a force-transmitting attachment of a first force-absorbing structural part to a second force-absorbing structural part, the connecting assembly comprising:

a tensile force-transmitter;

a shearing force-transmitter;

a compressive force-transmitter;

said compressive force-transmitter including at least one compression element defining a rod-like section made of metallic material;

a joint disposed between said first and second force-absorbing structural parts;

said rod-like section being arranged in said joint between said first and second force-absorbing structural parts; and, said rod-like section defining a flow section having a constant cross-sectional area reduced relative to said rod-like section.

2. The connecting assembly of claim 1, wherein said rod-like section has a length and said material has an elastic limit; and, said cross-sectional area of said flow section and the length of said rod-like section are coordinated with each other so as to cause the material in said flow section to reach the elastic limit thereof under a compressive load before said rod-like section buckles.

3. The connecting assembly of claim 1, wherein said rod-like section has a maximum cross-sectional area; and, said cross-sectional area of said flow section is 55% to 80% of said maximum cross-sectional area of said rod-like section.

4. The connecting assembly of claim 3, wherein said cross-sectional area of said flow section lies in a range of 56% to 76% of said maximum cross-sectional area of said rod-like section.

5. The connecting assembly of claim 1, wherein said rod-like section has a maximum external diameter (d); and, said flow section has a width (b) lying in a range of 15% to 25% of said maximum external diameter (d) of said rod-like section.

6. The connecting assembly of claim 1, wherein said rod-like section has a maximum diameter (d); and, said flow section has a width (b) lying in a range of 17% to 23% of said maximum external diameter (d) of said rod-like section.

7. The connecting assembly of claim 1, wherein said flow section has a width (b) lying in a range of 3 mm to 15 mm.

8. The connecting assembly of claim 1, wherein said flow section is delimited by a shoulder at least at one end thereof.

9. The connecting assembly of claim 1, wherein said rod-like section is configured as a smooth rod or threaded rod having a constant diameter outside of said flow section.

10. The connecting assembly of claim 1, wherein said at least one compression element is a compression rod.

11. The connecting assembly of claim 1, wherein said at least one compression element includes a pressure plate for embedding in one of said first and second force-absorbing structural parts.

12. The connecting assembly of claim 1, wherein said at least one compression element includes at least two of said flow sections.

13. The connecting assembly of claim 1, wherein said connecting assembly is configured so as to cause said first force-absorbing structural part to be fixed on said second force-absorbing structural part subsequent to completion of said first force-absorbing structural part and said second force-absorbing structural part.

14. A structure comprising:

a first force-absorbing structural part;

a second force-absorbing structural part;

a joint disposed between said first and second force-absorbing structural parts;

a connecting assembly for a force-transmitting attachment of said first force-absorbing structural part to said second force-absorbing structural part;

said connecting assembly including: a tensile force-transmitter, a shearing force-transmitter and a compressive force-transmitter;

said compressive force-transmitter including at least one compression element defining a rod-like section made of metallic material;

said rod-like section being provided for arrangement in said joint between said first and second force-absorbing structural parts; and, said rod-like section defining a flow section having a constant cross-sectional area reduced relative to said rod-like section.

15. The structure of claim 14, wherein said joint has a width (f); and, said flow section has a width (b) lying in a range of 5% to 10% of said width (f) of said joint.

16. The structure of claim 14, wherein said joint has a width (f); and, said flow section is at a spacing (c) from said first force-absorbing structural part of less than 50% of said width (f) of said joint.

17. The structure of claim 14, wherein said joint has a width (f); and, said flow section is at a spacing (c) from said first force-absorbing structural part of less than 40% of said width (f) of said joint.

18. The structure of claim 14, wherein said compression force-transmitter includes at least three of said compression elements having respective flow sections; and, said first force-absorbing structural part is connected via said at least three compression elements to said second force-absorbing structural part.

19. The structure of claim 18, wherein said at least three compression elements are separated one from the other by a spacing (g) of at least 8 cm.

20. The structure of claim 14, wherein said first force-absorbing structural part is a steel part or a reinforced concrete part.

21. The structure of claim 14, wherein said connecting assembly is configured as a module including at least two of said compression elements.

22. The structure of claim 21, wherein said joint defines a longitudinal direction; and, said module has a width (h) of at least 30 cm measured in said longitudinal direction of said joint.

23. The structure of claim 21, further comprising: at least two of said modules connecting said first force-absorbing structural part to said second force-absorbing structural part.

24. The structure of claim 21, further comprising: at least three of said modules connecting said first force-absorbing structural part to said second force-absorbing structural part.

* * * * *